US006069644A

United States Patent [19]

Tanioka et al.

[11] Patent Number: 6,069,644

[45] **Date of Patent: *May 30, 2000**

[54] RECORDING HEAD AND IMAGE FORMING APPARATUS USING THE SAME

[75] Inventors: Hiroshi Tanioka, Yokohama; Toshihiko Ohtsubo, Machida; Mitsuru Amimoto; Shigeo Hata, both of Yokohama, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/801,365

[22] Filed: Feb. 19, 1997

[30] Foreign Application Priority Data

Feb. 20, 1996 [JP] Japan ..... 8-031733
Mar. 26, 1996 [JP] Japan ..... 8-070187

[51] Int. Cl.[7] ..... B41J 2/45
[52] U.S. Cl. ..... 347/238
[58] Field of Search ..... 347/238, 130

[56] References Cited

U.S. PATENT DOCUMENTS

| | | | |
|---|---|---|---|
| 4,640,601 | 2/1987 | Deguchi et al. | 355/1 X |
| 4,907,034 | 3/1990 | Doi et al. | 355/400 |
| 5,451,977 | 9/1995 | Kusuda et al. | 345/44 |
| 5,475,417 | 12/1995 | Ogata et al. | 347/244 |

FOREIGN PATENT DOCUMENTS

| | | | |
|---|---|---|---|
| 335553A2 | 10/1989 | European Pat. Off. . | |
| 432917A2 | 6/1991 | European Pat. Off. . | |
| 4308896 | 9/1994 | Germany . | |
| 60-48383 | 3/1985 | Japan | B41J 3/21 |
| 61-202859 | 9/1986 | Japan | B41J 3/21 |
| 1-238962 | 9/1989 | Japan . | |
| 2-2080 | 1/1990 | Japan . | |

*Primary Examiner*—N. Le
*Assistant Examiner*—Judy Nguyen
*Attorney, Agent, or Firm*—Fitzpatrick, Cella, Harper & Scinto

[57] ABSTRACT

A recording head includes a light emitting element array having a plurality of light emitting elements, a first substrate on which the light emitting element array is carried, a drive element for driving the light emitting element array, a second substrate on which the drive element is carried, and a connecting member for connecting the first substrate and the second substrate together. A wiring pattern formed on the first substrate and an electrically conductive pattern on the connecting member are connected together by wire bonding.

20 Claims, 11 Drawing Sheets

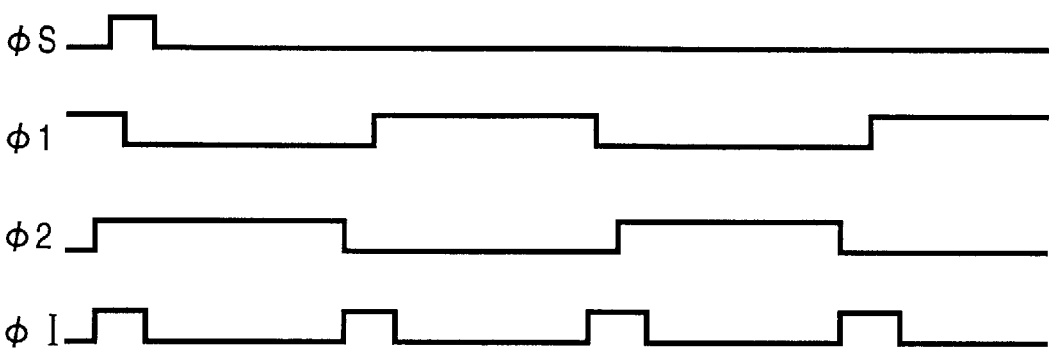
FIG. 5A
FIG. 5B
FIG. 5C
FIG. 5D
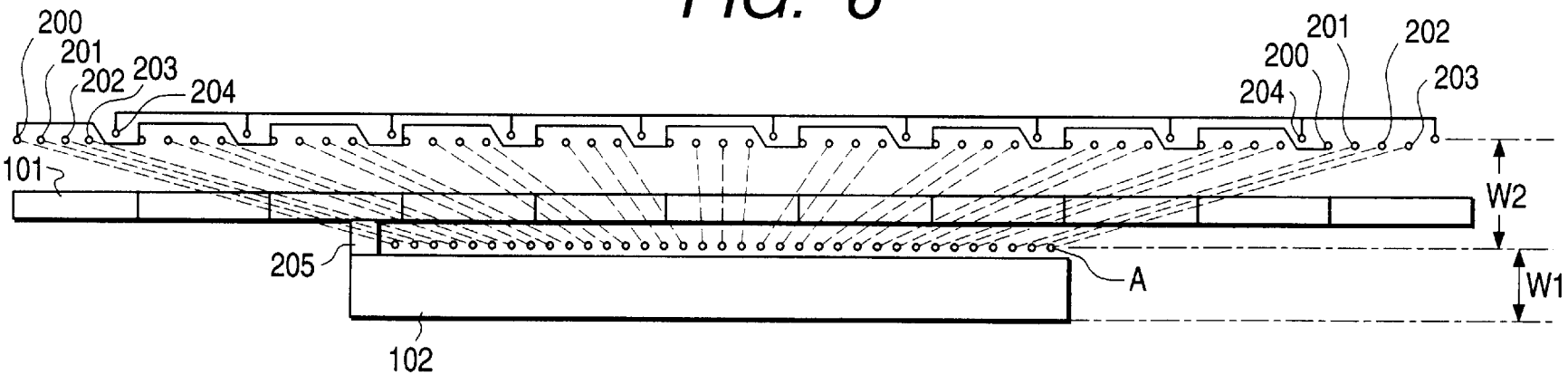
FIG. 6

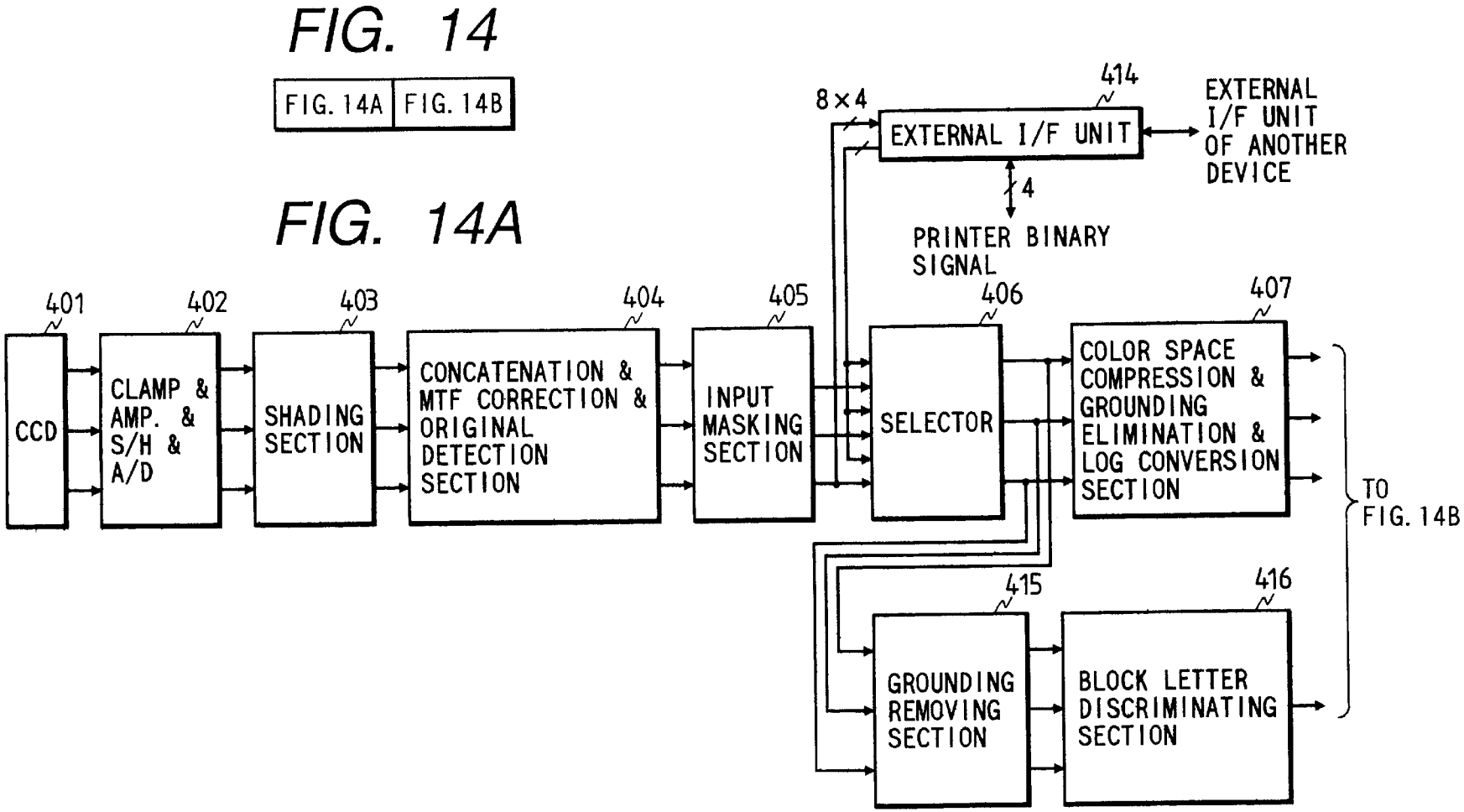
FIG. 14
FIG. 14A
FIG. 14B
FIG. 14A
CCD
401
CLAMP & AMP. & S/H & A/D
402
SHADING SECTION
403
CONCATENATION & MTF CORRECTION & ORIGINAL DETECTION SECTION
404
INPUT MASKING SECTION
405
8×4
EXTERNAL I/F UNIT
414
EXTERNAL I/F UNIT OF ANOTHER DEVICE
4
PRINTER BINARY SIGNAL
SELECTOR
406
COLOR SPACE COMPRESSION & GROUNDING ELIMINATION & LOG CONVERSION SECTION
407
TO FIG. 14B
GROUNDING REMOVING SECTION
415
BLOCK LETTER DISCRIMINATING SECTION
416

RECORDING HEAD AND IMAGE FORMING APPARATUS USING THE SAME

BACKGROUND OF THE INVENTION

1. Field of the Invention

This invention relates to a recording head for use as a printing head in an image forming apparatus such a as a printer, a copying apparatus or a facsimile apparatus.

2. Related Background Art

Heretofore, as a recording head of this kind, a solid light emitting element array typified by LEDs (light emitting diodes) is arranged in a row and individual light emitting elements are controlled in conformity with a recording signal to thereby effect recording. Also, in such a recording head, a drive circuit is provided correspondingly to each individual light emitting element of the light emitting element array, and a drive IC in which these drive circuits are integrated is disposed adjacent to the light emitting element array chips and the two chips are connected together by wire bonding. On the other hand, recently, a light emitting element array having the self-scanning function so as to successively select and drive light emitting elements in the array chip is also proposed in U.S. Pat. No. 5,451,977. The use of such a light emitting element array having the self-scanning function can remarkably curtail the number of wirings connecting the light emitting element array and a drive IC together and therefore, when the light emitting element array chip and the drive IC are carried on discrete substrates, it becomes possible to connect the two substrates together by the use of a flexible cable.

Now, if there is adopted such structure that the light emitting element array chip and drive IC of a recording head are carried on discrete substrates and the substrate carrying the light emitting element array chip thereon is opposed to a photosensitive drum, the thickness (height) of the recording head can be made very small and therefore, the use of a photosensitive drum of a smaller diameter becomes possible and thus, it becomes possible to downsize an apparatus such as a printer or a copying apparatus using it. However, when the substrate carrying the light emitting element array chip thereon and the substrate carrying the drive IC thereon, or the substrate carrying the light emitting element array chip thereon and a flexible cable are connected together, there has been the following problem.

When such a substrate and a cable are to be connected together, use is usually made of a connecting method using soldering heat welding, but during the connection, a flux or the like is scattered and adheres to the surface of the light emitting element array chip to thereby cause the deterioration of its characteristics, for example, creating an irregular quantity of emitted light. Therefore, when the substrate and the flexible cable are to be connected together, it is necessary to connect the two together with the tip end of the cable spaced apart relative to the light emitting element array chip on the substrate to a certain degree, and to secure a distance corresponding to the spacing apart, the width of the substrate must be increased in conformity therewith. However, if the width of the substrate for the light emitting element array chip is increased, the recording a head will become correspondingly bulky and therefore, the downsizing of the recording head is limited. Decreasing the width of the substrate carrying the light emitting element array thereon has been a task in further downsizing the recording head.

SUMMARY OF THE INVENTION

So, in view of the above-noted problem peculiar to the prior art, it is a first object of the present invention to provide a recording head in which a substrate carrying a light emitting element array thereon and a connecting member are connected together by wire bonding to thereby make the width of the substrate smaller and which can thus be made more compact.

The first object of the present invention is achieved by a recording head in which a light emitting element array having a plurality of light emitting elements and a drive element for driving the light emitting element array are carried on discrete substrates and the substrate on which the light emitting element array is carried and the substrate on which the drive element is carried are electrically connected together by a connecting member, whereby the signal of the drive element is supplied to the light emitting element array, characterized in that when the substrate on which the light emitting element array is carried and the connecting member are to be electrically connected together, a wiring pattern formed on the substrate on which the light emitting element array is carried and an electrically conductive pattern on the connecting member are connected together by wire bonding.

Also, in view of the above-noted problem peculiar to the prior art, it is a second object of the present invention to provide a recording head in which the deterioration of the characteristics of a light emitting element array by the scattering of a flux or the like can be prevented without the width of a substrate being made great.

The second object of the present invention is achieved by a recording head in which a light emitting element array having a plurality of light emitting elements and a drive element for driving the light emitting element array are carried on discrete substrates and the substrate on which the light emitting element array is carried and the substrate on which the drive element is carried are electrically connected together by a connecting member, whereby the signal of the drive element is supplied to the light emitting element array, characterized in that when the substrate on which the light emitting element array is carried and the connecting member are to be electrically connected together, they are connected together by heat welding on a surface opposite to the surface of the substrate on which the light emitting element array is carried.

BRIEF DESCRIPTION OF THE DRAWINGS

FIGS. 5A, 5B, 5C and 5D are time charts for illustrating the operation of the light emitting element array chip of FIG. 4.

FIG. 6 shows the wiring pattern of a substrate on which the light emitting element array chip of the recording head of FIG. 1 is carried.

DESCRIPTION OF THE PREFERRED EMBODIMENTS

Figure 1:
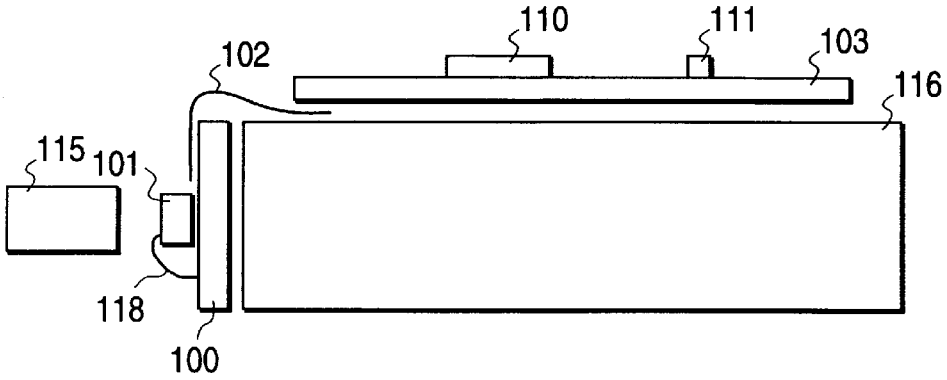
FIG. 1 is a side view showing the appearance of a first embodiment of a recording head according to the present invention.

Some embodiments of the present invention will hereinafter be described in detail with reference to the drawings. FIG. 1 is a side view showing a first embodiment of a recording head according to the present invention. In FIG. 1, reference numeral 101 designates a light emitting element array chip containing therein a self-scanning circuit having a number of light emitting elements therein. In this embodiment, for example, fifty-five such light emitting element array chips 101 are provided and they are carried in a row on a substrate 100. Reference numeral 110 denotes drive ICs for driving the individual light emitting elements of the light emitting element array chips 101, and reference numeral 111 designates current limiting resistors for limiting the driving current of the light emitting elements, and these resistors are carried on a substrate 103 discrete from the substrate 100.

The substrate 100 on which the light emitting element array chips 101 are carried is mounted on a side of an aluminum base material 116 for radiation, and the substrate 103 on which the drive ICs 110 and the current limiting resistors 111 are carried is mounted on the upper surface of the aluminum base material 116. Accordingly, in FIG. 1, the substrate 100 and the substrate 103 are mounted on the two adjacent surfaces of the aluminum base material 116 at an angle of 90°, and a flexible cable 102 is extended at the position of the angle of 90°, and the end portions of the flexible cable 102 and the two substrates 100 and 103 are electrically connected together.

When the substrate 103 and the flexible cable 102 are to be connected together, there is adopted a method of connecting a wiring pattern formed on the back of the substrate 103 and the electrically conductive pattern of the flexible cable 102 together by soldering heat welding, as shown in FIG. 1. Also, when the substrate 100 and the flexible cable 102 are to be connected together, there is adopted a method of connecting a wiring pattern formed on the substrate 100 and the electrically conductive pattern of the flexible cable 102 together by wire bonding. This connecting structure will be described later in detail.

In this manner, the substrate 100 and the substrate 103 are electrically connected together, and a timing signal and a driving signal from the drive ICs 110 necessary to drive the light emitting element array chips 101 are supplied to the substrate 100. Further, in FIG. 1, a converging type optical fiber array 115 is provided in opposed relationship with the light emitting element array chips 101 on the substrate 100. The lights of the individual pixels (light emitting elements) of the light emitting element array chips 101 are converged by the converging type optical fiber array 115, and are applied as recording dots to a photosensitive drum (not shown). In FIG. 1, reference numeral 118 denotes wire bonding for connecting the wiring pattern of the substrate 100 and the electrodes of the light emitting element array chips 101 together as will be described later.

Figure 2:
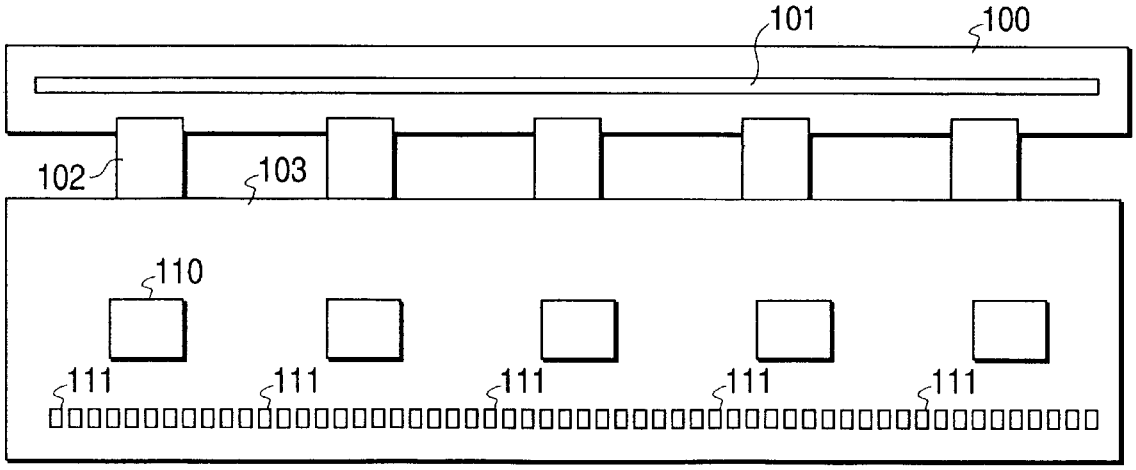
FIG. 2 shows the substrates 100 and 103 of the recording head of FIG. 1 and a flexible cable 102 as they are developed in the fashion of a plan view.

FIG. 2 is a plan view in which the substrates 100, 103 and the flexible cable 102 are developed in the fashion of a plan view. In FIG. 2, the substrate 100 is of a rectangular shape narrow in width, and the light emitting element array chips 101 are carried in the lengthwise direction thereof. In the present embodiment, fifty-five light emitting element array chips 101 each having 128 pixels are arranged straight in a row. Also, five drive ICs 110 and fifty-five current limiting resistors 111 are carried on the substrate 103. The drive ICs 110 each are adapted to drive eleven light emitting element array chips 101, and five drive ICs 110 in total are carried on the substrate 103.

Also, each one of the current limiting resistors 111 is necessary for each of the light emitting element array chips 101, and fifty-five current limiting resistors 111 are carried correspondingly to the respective light emitting element array chips 101. The substrates 100 and 103 are electrically connected together by five flexible cables 102, and in the present embodiment, a drive IC 110 drives eleven light emitting element array chips 101 and therefore, signals necessary for the driving of eleven light emitting element array chips 101 by each drive IC 110 are supplied by the use of the five flexible cables 102.

As each of the flexible cables 102, use is made of a cable having a width of about 25 mm and having 36 signal lines arranged at a pitch of 0.7 mm therein. In this case, as will be described later in detail, a signal $\phi S$ which is a scanning pulse signal, signals $\phi 1$ and $\phi 2$ which are drive timing signals and a signal $\phi I$ which is a driving signal for turning on and off the pixels are necessary to drive a light emitting element array chip 101. In addition to this, the connection of a power source and GND is also necessary.

In the present embodiment, as previously described, eleven light emitting element array chips 101 are driven by a drive IC 110, but the scanning pulse signal $\phi S$, the power source and GND are supplied in common and therefore, three signal lines for supplying the drive timing signals $\phi 1$, $\phi 2$ and the driving signal $\phi I$ are required per light emitting element array chip and thus, thirty-three signal lines are necessary for eleven light emitting element array chips. Accordingly, when three signal lines for supplying in common are added to them, thirty-six signal lines are necessary and therefore, as previously described, by the use of five flexible cables 102 having thirty-six signal lines, the signal of each drive IC 110 is supplied to the fifty-five light emitting element array chips 101 on the substrate 100.

Also, in the present embodiment, self-scanning emitting devices are used as the light emitting element array chips 101. In the recording head of FIG. 1, fifty-five such light emitting element array chips 101 are arranged in a row and are designed so as to be capable of recording at a density of 600 DPI. This recording head can be suitably used, for example, in a copying apparatus of the electrophotographic type, a printer or the like. The self-scanning emitting device is disclosed in detail, for example, in Japanese Laid-Open Patent Application No. 1-238962, Japanese Laid-Open Patent Application No. 2-2080, etc. and therefore need not be described in detail.

Figure 3:
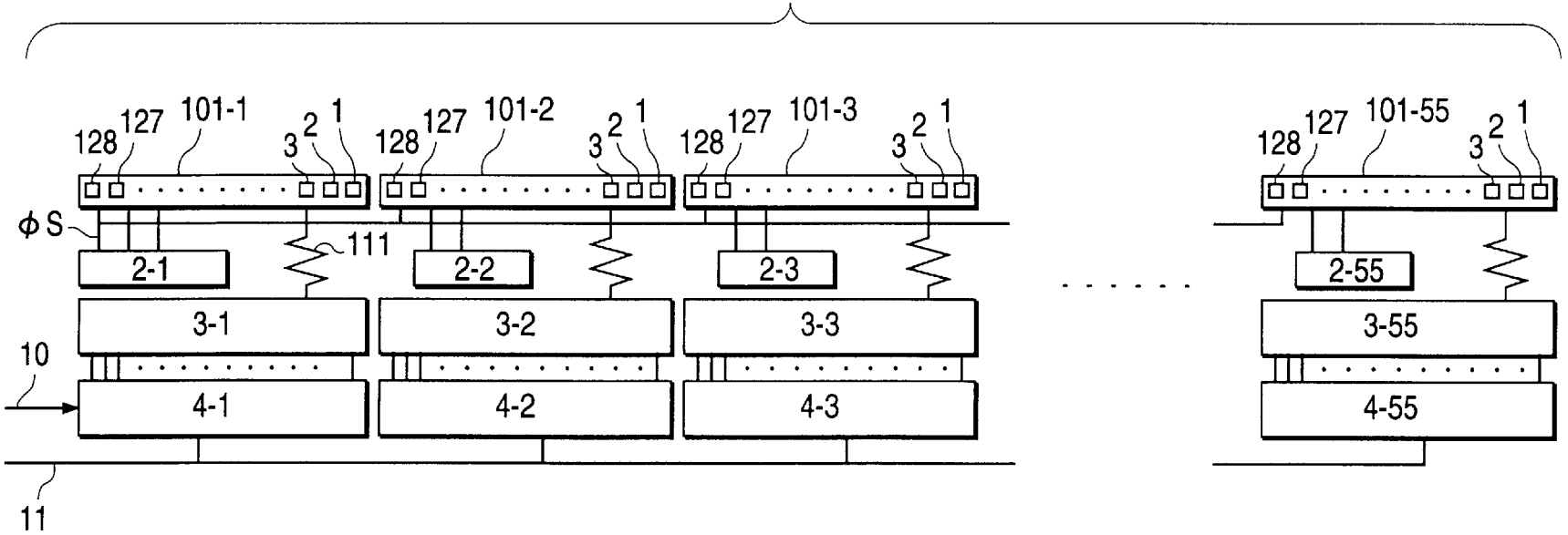
FIG. 3 is a block diagram showing an example of the electrical construction of the recording head of FIG. 1.

FIG. 3 is a block diagram showing the electrical circuit construction of the recording head of FIG. 1. In FIG. 3, reference numerals 101-1 to 101-55 designate the fifty-five light emitting element array chips arranged in a row on the substrate 100 as previously described. In each light emitting element array chip 101, thyristors for light emission which are recording elements are arranged in a row corresponding to 128 pixels as indicated by 1, 2, 3, . . ., 128, and as the whole of the recording head, there are arranged 7040 (55× 128) bits of pixels per line. Reference numerals 2-1 to 2-55 denote timing signal producing circuits for producing the scanning pulse signal φS and the drive timing signals φ1 and φ2 necessary to drive each light emitting element array chip. These timing signal producing circuits are provided correspondingly to the individual light emitting element array chips, and eleven such circuits as one set are integrated in a drive IC 110. Also, the drive timing signals φ1 and φ2 of each timing signal producing circuit are supplied to the corresponding light emitting element array chip, and only the scanning pulse signal φS is supplied in common from a timing signal producing circuit to eleven light emitting element array chips.

Reference numerals 4-1 to 4-55 designate shift registers for introducing image signals thereinto, and reference numerals 3-1 to 3-55 denote latches for holding the image signals introduced into the respective shift registers. These shift registers and latches are also provided correspondingly to the individual light emitting element array chips, and eleven shift registers and eleven latches as one set each are integrated in a drive IC. In this manner, the drive circuit of the light emitting element array chips is constituted by the timing signal producing circuits, the shift registers and the latches, and each eleven such circuits are integrated as a drive IC. Reference numeral 111 designates the current limiting resistors shown in FIGS. 1 and 2, and each of them is connected between each latch and each light emitting element array chip. The driving signal φI for driving the pixels of the individual light emitting element array chips is time-divisionally supplied from each latch to the corresponding light emitting element array chip through the current limiting resistor 111.

Here, the image signal is inputted from a signal line 10 to the shift register 4-1, and is transferred from a signal line 11 to the shift registers 4-2 to 4-55 in synchronism with a predetermined clock. When image signals corresponding to a line are transferred, the signal of each shift register 4 is held in the corresponding latch 3, and the signal of each latch 3 is time-divisionally supplied to the corresponding light emitting element array chip as in the order of thyristors 1, 2, 3, . . ., 128 for light emission. In this case, as regards the signal of the latch 3, the logical product with an extraneous timing signal (not shown) is taken, and is supplied to the light emitting element array chip as a recording signal φI for turning on/turning off the individual thyristors for light emission. Of course, the timing of the self-scanning of each light emitting element array chip and the timing of the recording signal φI are synchronized with each other. In this manner, fifty-five light emitting element array chips are scanned at a time, whereby the recording of a line is terminated, and thereafter a similar operation is repeated for each one line, whereby desired recording can be accomplished.

Figure 4:
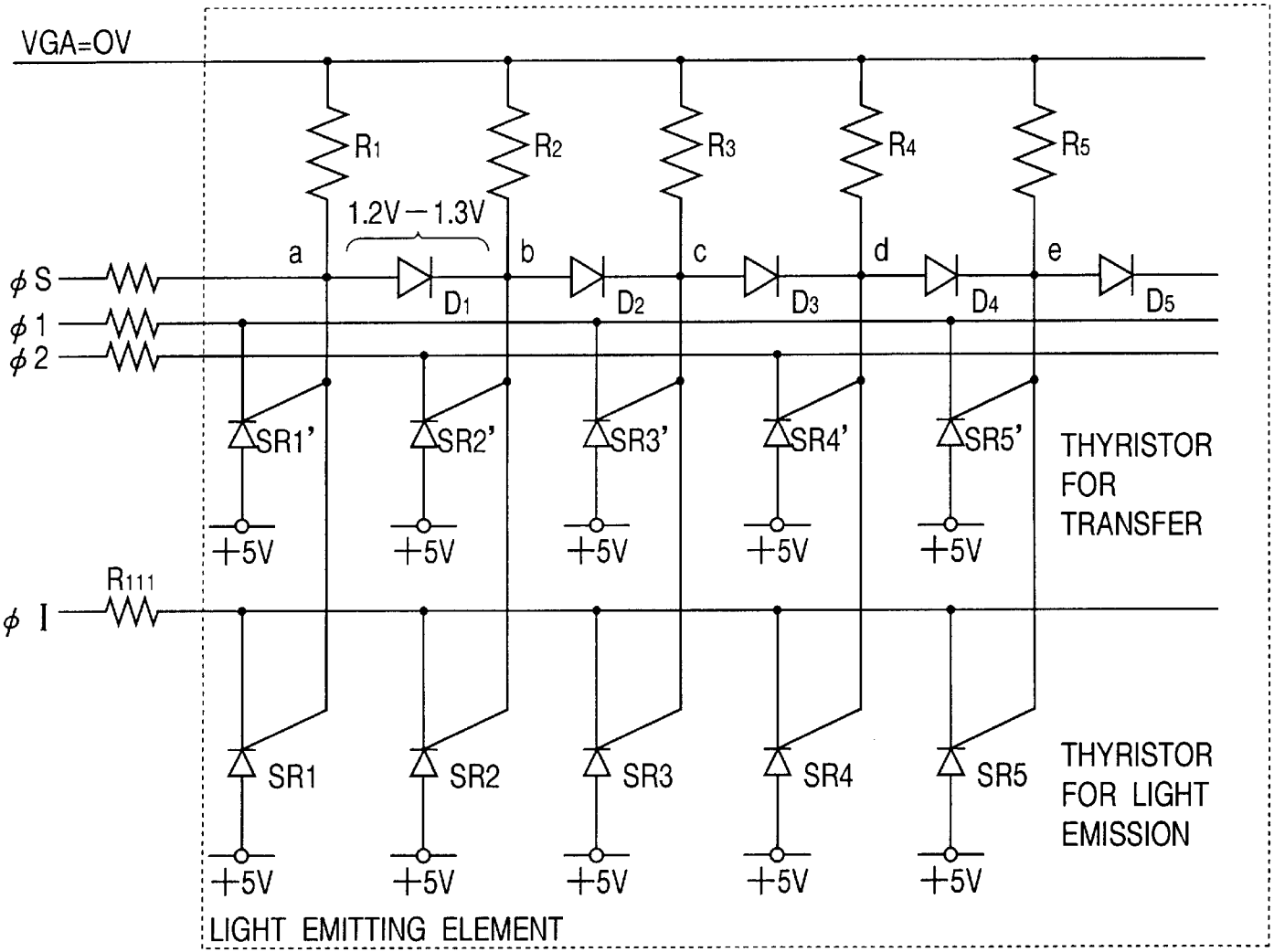
FIG. 4 is a circuit diagram showing the equivalent circuit of a light emitting element array chip used in the recording head of FIG. 1.

The construction and operation of the self-scanning emitting device chip will now be described. FIG. 4 is a circuit diagram showing its equivalent circuit, and SR1 to SR5 denote thyristors for light emission which are light emitting elements. These correspond to the pixels indicated as 1 to 128 in FIG. 3. Also, SR1' to SR5' designate thyristors for transfer provided correspondingly to the thyristors SR1 to SR5 for light emission, $D_1$ to $D_5$ denote diodes connected in series, and $R_1$ to $R_5$ designate resistors. The self-scanning circuit of the thyristors for light emission is constituted by the thyristors for transfer, the diodes and the resistors. In FIG. 4, the thyristors for light emission are shown only for five pixels, but actually thyristors for light emission corresponding to 128 pixels are arranged in a light emitting element array, and the other thyristors for transfer, diodes and resistors are also provided correspondingly thereto.

The scanning pulse signal φS is inputted to the anode terminal of the diode $D_1$, the drive timing signal φ1 is inputted to the cathode terminal of the odd number thyristors SR1', SR3', SR5', . . . for transfer which is connected in common, and the drive timing signal φ2 is inputted to the cathode terminal of the even number thyristors SR2', SR4', . . . for transfer which is connected in common. Also, the driving signal φI is inputted to the cathode terminal of the thyristors for light emission which is connected in common. These signals are shown in FIGS. 5A to 5D.

First, when as shown in FIG. 5A, the scanning pulse signal φS changes from a low level to a high level, the operation of the light emitting element array chips starts. Next, when in the state in which the scanning pulse signal φS is at a high level, the drive timing signal φ1 changes from a high level to a low level as shown in FIG. 5B, the top thyristor SR1' for transfer assumes its ON state. When the thyristor SR1' for transfer becomes ON, the gate voltage thereof becomes the anode potential (about 5V) and therefore, when as shown in FIG. 5D, the recording signal φI changes from a high level to a low level, the top thyristor SR1 for light emission is turned on and emits light for a predetermined time for recording. The light of this thyristor SR1 for light emission is applied to a photosensitive drum through the optical fiber array 115 as previously described. The other thyristors for light emission are not emitting light because the gate voltage is not 5V.

When as shown in FIG. SD, the recording signal φI then returns from the low level to the high level, the top thyristor SR1 for light emission is turned off, and when as shown in FIG. 5C, the drive timing signal φ2 changes from a high level to a low level at the next timing, the next thyristor SR2' for transfer is turned on. That is, the gate voltage (about 5V) of the thyristor SR1' for transfer is connected to the gate of the thyristor SR2' for transfer through the diode $D_1$ connected to the gate of the thyristor SR1' for transfer and therefore, the gate voltage of the thyristor SR2' for transfer becomes about 3.6V. Accordingly, when in this state, the timing signal φ2 assumes a low level, the thyristor SR2' for transfer assumes its ON state. When subsequently, as shown in FIG. 5B, the drive timing signal φ1 changes from the low level to the high level, the thyristor SR1' for transfer is turned off, while the thyristor SR2' for transfer holds its ON state, and when in this state, as shown in FIG. 5D, the recording signal φI assumes the low level, the next thyristor SR2 for light emission is turned on for a predetermined time. This operation is repeated 64 times, whereby the thyristors for light emission are time-divisionally driven in succession.

Description will now be made of the connecting structure for connecting the substrate 100 carrying the light emitting element array chips 101 thereon and the flexible cable 102 together. First, FIG. 6 shows the wiring pattern of the substrate 100. In FIG. 6, there is shown only the wiring pattern for eleven light emitting element array chips, of the wiring pattern of the whole. Also, in the present embodiment, a two-surface substrate is used as the substrate 100. In FIG. 6, reference numeral 102 designates the tip end portion of the flexible cable, and this tip end portion is secured to the substrate 100 with a width of W1 by the use of an adhesive agent such as silver paste. In the present embodiment, W1 is about 3 mm. Also, in proximity to this tip end portion of the flexible cable 102, eleven light emitting element array chips 101 are disposed in a row. The flexible cable 102, as previously described, has thirty-six signal lines, each of which is connected to the wiring pattern on the substrate 100 by wire bonding. In FIG. 6, thirty-six points A between the light emitting element array chips 101 and the tip end of the flexible cable 102 indicate the connection points by this wire bonding.

Figure 7:
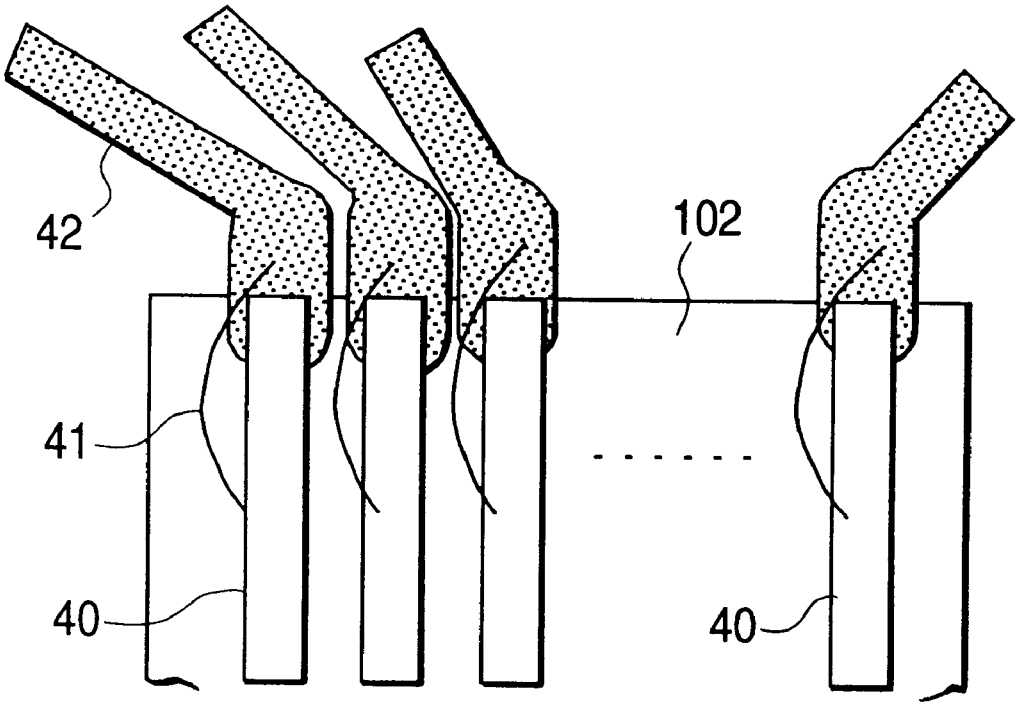
FIG. 7 shows in detail a connecting portion for electrically connecting the substrate on which the light emitting element array chip of the recording head of FIG. 1 is carried and the flexible cable together.

FIG. 7 shows the connection points by the wire bonding in detail. On the tip end of the flexible cable 102, there are formed thirty-six electrically conductive patterns 40 for connecting the signal lines together. Also, on the substrate 100, wiring patterns 42 are formed correspondingly to the individual electrically conductive patterns 40, and the electrically conductive patterns 40 on the flexible cable 102 and the wiring patterns 42 on the substrate 100 are connected together by wire bondings 41. In the present embodiment, a wire of about 1.5 mm is used to effect wire bonding. In this manner, the flexible cable 102 and the substrate 100 are electrically connected together, and the signal lines from the flexible cable 102 are further connected to wire bonding pads 200 to 204 for being wire-bonded to the individual light emitting element array chips through wiring patterns (indicated by broken line) radially formed on the back of the substrate 100. In the present embodiment, a width W2 required for these radial wiring patterns to be connected to the wire bonding pads is about 3 mm.

The wire bonding pad (hereinafter abbreviated as WP) 200 is a pad for connecting the signal line of the scanning pulse signal $\phi S$ to the light emitting element array chips 101, and the WP 201 is a pad for connecting the signal line of the drive timing signal $\phi 1$. Also, the WP 202 is a pad for connecting the signal line of the drive timing signal $\phi 2$, the WP 203 is a pad for connecting the signal line of the driving signal $\phi I$, and the WP 204 is a pad for connecting GND. As regards the WP 200 and the WP 204, eleven chips are connected in common by the wiring pattern, and the other WPs 201 to 203 are independent for each chip.

Figure 8:
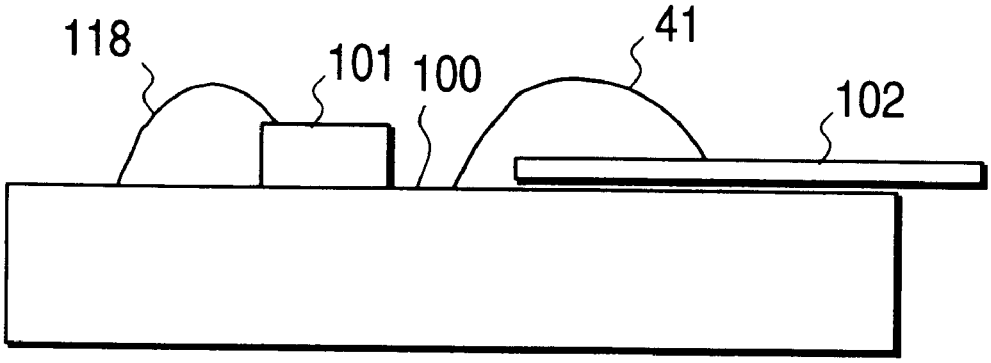
FIG. 8 is a side view in which the substrate on which the light emitting element array chip of the recording head of FIG. 1 is carried is seen from a side thereof.

These WPs 200 to 204 are provided correspondingly to the individual light emitting element array chips, and the WPs 200 to 204 and the electrodes (not shown) of the individual light emitting element array chips are connected together by wire bonding 118 as shown in FIG. 8. In this manner, the signal lines of the flexible cable 102 are connected to the light emitting element array chips, and the signals $\phi S$, $\phi 1$, $\phi 2$ and $\phi I$ as previously described are supplied to the individual light emitting element array chips. While in FIG. 6, the connection of a flexible cable 102 has been described, the remaining four flexible cables are also connected by entirely the same method. In FIG. 6, reference numeral 205 designates a power source pattern.

In the present embodiment, the flexible cables 102 and the substrate 100 on which the light emitting element array chips 101 are carried are connected together by wire bonding and therefore, the flux is not scattered as in the connection by soldering heat welding, and the deterioration of the characteristics of the light emitting element array chips can be avoided. Also, since there is not the scatter of the flux, the tip ends of the flexible cables can be connected in closer proximity to the light emitting element array chips. Accordingly, the width of the substrate 100 carrying the light emitting element array chips thereon may be the widths W1 and W2 shown in FIG. 6, and the width of the substrate 100 can be made much smaller than when the connection is done by soldering heat welding. Also, correspondingly to the smaller width of the substrate 100, the recording head can be made more compact and therefore, in an apparatus using it, the use of a photosensitive drum having a smaller diameter becomes possible, and this can contribute to the downsizing of the apparatus.

In the above-described embodiment, eleven light emitting element array chips are driven by a drive IC, but more chips can be driven by a drive IC. In this case, when the number of light emitting element array chips to be driven by a drive IC increases, the width W2 required for the radial wiring patterns of FIG. 6 becomes greater, but in the present invention, it is possible to offset the increase in the width by bringing the flexible cables close to the light emitting element array chips. That is, in the present invention, the connection by wire bonding is adopted and therefore, the tip ends of the flexible cables can be brought closer and connected to the light emitting element array chips, and with the width of the substrate 100 kept as it is, the number of light emitting element array chips driven by a drive IC can be increased.

Also, in the above-described embodiment, the substrate 100 carrying the light emitting element array chips thereon is a two-surface substrate, but a multilayer substrate may also be used. Further, there has been shown an example in which self-scanning emitting device chips are used as the light emitting element array chips, whereas the present invention is not restricted thereto, but can also be applied to a case where use is made of other light emitting elements such as LEDs having similar self-scanning circuits and capable of being time-divisionally driven as usual.

As described above, according to the present invention, the substrate on which the light emitting element array chips are carried and the connecting member are connected by wire bonding, whereby there is not the scatter of the flux and therefore, the connecting member can be brought as close as possible and connected to the light emitting element array chips, and as compared with a case where the connection is done by soldering heat welding, the width of the substrate carrying the light emitting element array chips thereon can be made very small. Accordingly, the recording head can be made more compact and therefore, in an apparatus using it, the use of a photosensitive drum having a smaller diameter is made possible, and this also can contribute to the downsizing of the apparatus.

Figure 9:
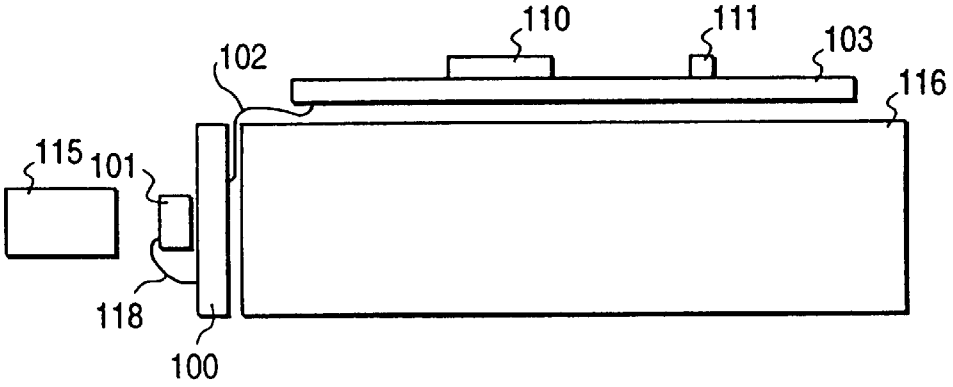
FIG. 9 is a side view showing the appearance of a second embodiment of the recording head according to the present invention.

A further embodiment of the present invention will hereinafter be described in detail with reference to the drawings. FIG. 9 is a side view showing a second embodiment of the recording head according to the present invention. In FIG. 9, reference numeral 101 designates a light emitting element array chip containing therein a self-scanning circuit having a number of light emitting elements therein. Fifty-five such light emitting element array chips 101 are provided, and they are carried in a row on a substrate 100. Reference numeral 110 denotes drive ICs for driving the individual light emitting elements of the light emitting element array chips 101, and reference numeral 111 designates current limiting resistors for limiting the driving current of the light emitting elements, and the current limiting resistors 111 are carried on a substrate 103 discrete from the substrate 100.

The substrate 100 on which the light emitting element array chips 101 are carried is mounted on a side of an aluminum base material 116 for radiation, and the substrate 103 on which the drive ICs 110 and the current limiting resistors 111 are carried is mounted on the upper surface of the aluminum base material 116. Accordingly, in FIG. 9, the substrate 100 and the substrate 103 are mounted on the two adjacent surfaces of the aluminum base material 116 at an angle of 90°, and a flexible cable 102 is extended at the position of the angle of 90°, and the end portions of the flexible cable 102 and the two substrates 100, 103 are electrically connected together.

When the substrates 100 and 103 and the end portions of the flexible cable 102 are to be connected together, there is adopted a method of connecting them together by soldering heat welding. Particularly, when the substrate 100 and the flexible cable 102 are to be connected together, they are connected together on the back of the substrate 100 to thereby eliminate the influence of the scatter of a flux or the like. This will be described later in detail. In FIG. 9, that portion of the surface of the aluminum base material 116 on which the substrate 100 is mounted which corresponds to the flexible cable 102 is scraped by the order of several hundred pm to thereby prevent the inclination of the substrate 100 due to the flexible cable 102 and the thickness of the solder.

In this manner, the substrate 100 and the substrate 103 are electrically connected together, and a timing signal and a driving signal from the drive ICs 110 necessary to drive the light emitting element array chips 101 are supplied to the substrate 100. Further, in FIG. 9, a converging type optical fiber array 115 is provided in opposed relationship with the light emitting element array chips 101 on the substrate 100. The lights of the individual pixels (light emitting elements) of the light emitting element array chips 101 are converged by the converging type optical fiber array 115 and are applied as recording dots to a photosensitive drum (not shown). The width of the converging type optical fiber array 115 is usually of the order of several mm and therefore, it depends on how small the width of the substrate 100 is made to use a photosensitive drum having a smaller diameter. In FIG. 9, reference numeral 118 designates wire bonding for connecting the wiring pattern of the substrate 100 and the electrodes of the light emitting element array chips 101 together.

Figure 10:
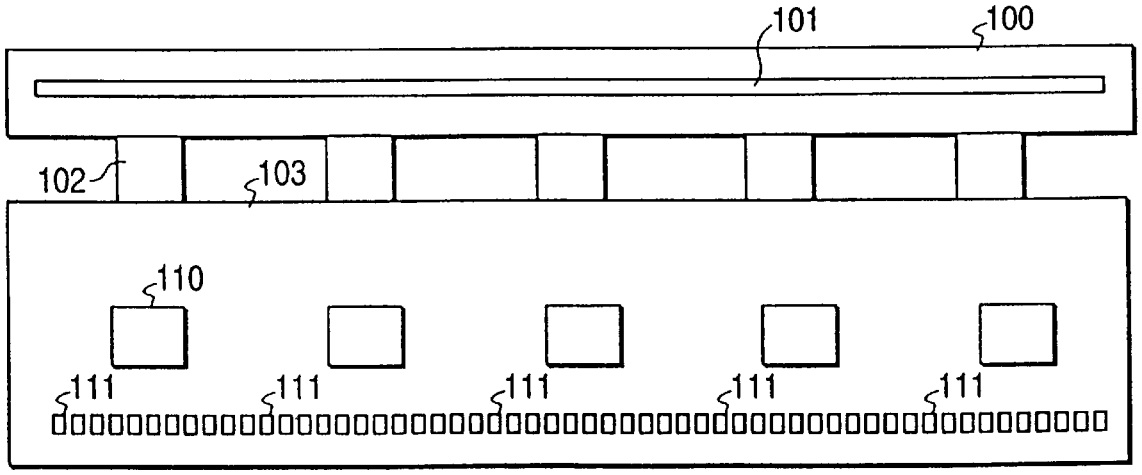
FIG. 10 shows the substrates 100 and 103 of the recording head of FIG. 9 and a flexible cable 102 as they are developed in the fashion of a plan view.

FIG. 10 is a plan view in which the substrates 100, 103 and the flexible cable 102 are developed in the fashion of a plan view. In FIG. 10, the substrate 100 is of a rectangular shape having a narrow width, and the light emitting element array chips 101 are carried thereon in the lengthwise direction thereof. In the present embodiment, fifty-five light emitting element array chips 101 each having 128 pixels are arranged straight in a row. Also, five drive ICs 110 and fifty-five current limiting resistors 111 are carried on the substrate 103. The drive ICs 110 each are adapted to drive eleven light emitting element array chips 101, and five drive ICs 110 in total are carried on the substrate 103.

Each one of the current limiting resistors 111 is necessary for each light emitting element array chip 101, and fifty-five current limiting resistors 111 corresponding to the respective light emitting element array chips 101 are carried on the substrate 103. The substrates 100 and 103 are electrically connected together by five flexible cables 102, and in the present embodiment, eleven light emitting element array chips 101 are driven by a drive IC 110 and therefore, signals necessary for the driving of eleven light emitting element array chips 101 by each drive IC 110 are supplied by the use of the five flexible cables 102.

The flexible cable 102 has a width of about 25 mm and has thirty-six signal lines arranged at a pitch of 0.7 mm therein. In this case, as will be described later in detail, a signal $\phi S$ which is a scanning pulse signal, signals $\phi 1$ and $\phi 2$ which are drive timing signals, and a signal $\phi I$ which is a driving signal for turning on/turning off the pixels are necessary to drive a light emitting element array chip 101. In addition to this, the connection of a power source and GND is also necessary.

In the present embodiment, as previously described, eleven light emitting element array chips 101 are driven by a drive IC 110, but the scanning pulse signal $\phi S$, the power source and GND are supplied in common and therefore, three signal lines for supplying the drive timing signals $\phi 1$ and $\phi 2$ and the driving signal $\phi I$ are required per light emitting element array chip and thus, thirty-three signal lines are necessary for eleven light emitting element array chips. According, when three signal lines for supply in common are added to them, thirty-six signal lines are necessary and therefore, as previously described, by the use of five flexible cables 102 having thirty-six signal lines, the signal of each drive IC 110 is supplied to the fifty-five light emitting element array chips 101 on the substrate 100.

Also, in the present embodiment, self-scanning emitting devices are used as the light emitting element array chips 101. In the recording head of FIG. 9, fifty-five such light emitting element array chips 101 are arranged in a row so that recording can be done at a density of 600 DPI. This recording head can be suitably used, for example, in a copying apparatus of the electrophotographic type, a printer or the like. The self-scanning emitting device is disclosed in detail, for example, in Japanese Laid-Open Patent Application No. 1-238962, Japanese Laid-Open Patent Application No. 2-2080, etc. and therefore need not be described in detail herein.

Also, a block diagram showing an example of the electrical construction of the recording head shown in FIG. 9 is similar to FIG. 3, a circuit diagram showing the equivalent circuit of the light emitting element array chips used in the recording head is similar to FIG. 4, and the time charts for illustrating the operation of the light emitting element array chips used in the recording head are similar to FIGS. 5A to 5D, and therefore need not be described herein.

Figure 11:
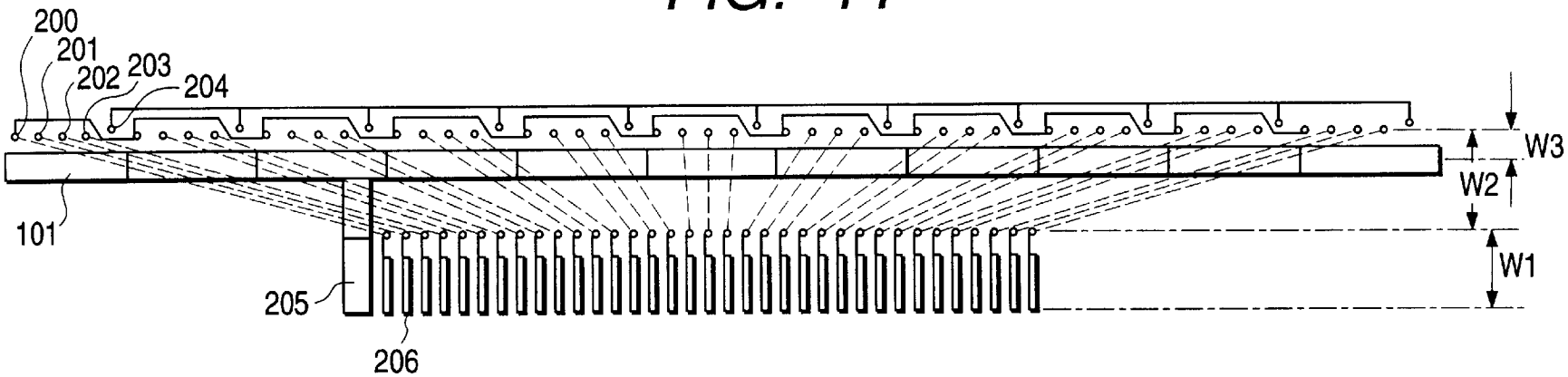
FIG. 11 shows the wiring pattern of a substrate on which the light emitting element array chip of the recording head of FIG. 9 is carried.

Description will now be made of the connecting structure for connecting the substrate 100 carrying the light emitting element array chips 101 thereon and the flexible cables 102 together. FIG. 11 shows the wiring pattern of the substrate 100. In FIG. 11, of the wiring pattern of the whole, only the wiring pattern for eleven light emitting element array chips is shown. Also, the substrate 100 is a two-surface substrate. In FIG. 11, reference numeral 206 designates electrically conductive patterns formed on the back of the substrate 100. Thirty-six electrically conductive patterns 206, including a common power source pattern 205, are formed. On the other hand, thirty-six terminals are provided on the tip end portions of the flexible cables 102, and on the back of the substrate 100, the terminals of the flexible cables 102 and the electrically conductive patterns of the substrate 100 are connected together by soldering heat welding. In the present embodiment, the width W1 required to connect the flexible cables 102 by soldering heat welding is about 3 mm.

Also, wiring patterns from the aforedescribed electrically conductive patterns are radially formed on the back of the substrate 100 as indicated by broken lines. The signal lines from the flexible cable 102 are connected to wire bonding pads 200 to 204 for wire-bonding them to the individual light emitting element array chips through these wiring patterns radially formed on the back of the substrate 100. In the present embodiment, the width W2 required for these radial wiring patterns to reach the wire bonding pads is about 3 mm. The wire bonding pad (hereinafter abbreviated as WP) 200 is a pad for connecting the signal line of the scanning pulse signal ϕS to the light emitting element array chips 101, and the WP 201 is a pad for connecting the signal line of the drive timing signal ϕ1. Also, the WP 202 is a pad for connecting the signal line of the drive timing signal ϕ2, the WP 203 is a pad for connecting the signal line of the driving signal ϕ1, and the WP 204 is a pad for connecting GND. As regards the WP 200 and the WP 204, eleven chips are connected in common by the wiring patterns, and the other WPs 201 to 203 are independent for each chip.

These WPs 200 to 204 are provided correspondingly to the individual light emitting element array chips. On the other hand, on the surface of the substrate 100, eleven light emitting element array chips 101 are arranged in a row, and the WPs 200 to 204 and the electrodes (not shown) of the individual light emitting element array chips are connected together by wire bonding 118 as shown in FIG. 9. In this case, the connection by the wire bonding is effected on a side opposite to the side on which the flexible cable 102 is connected to the substrate 100 by heat welding, i.e., a side opposite to the side on which the flexible cable 102 is connected to the light emitting element array chips 101. The width W2 required for wire bonding is about 1 mm. In this manner, the signal lines of the flexible cable 102 are connected to the light emitting element array chips, and the signals ϕS, ϕ1, ϕ2 and ϕI as described previously are supplied to the individual light emitting element array chips. In FIG. 11, the connection of a flexible cable 102 has been described, but the remaining four flexible cables are also connected by entirely the same method.

Here as the width of the substrate 100, the total of the width W1 required to connect the flexible cables 102 by heat welding, the width W2 required to form the radial wiring patterns to the wire bonding pads, and the width W3 required to effect wire bonding is necessary. In the present embodiment, when the wire bonding pads of the substrate 100 and the electrodes of the light emitting element array chips 101 are to be connected together by wire bonding, they are connected together on the side opposite to the connected side of the flexible cables 102 as previously described and therefore, the width W3 required for wire bonding is included in the width W2 of the wiring patterns, and the width of the substrate 100 may be substantially the total of W1 and W2.

Figure 12:
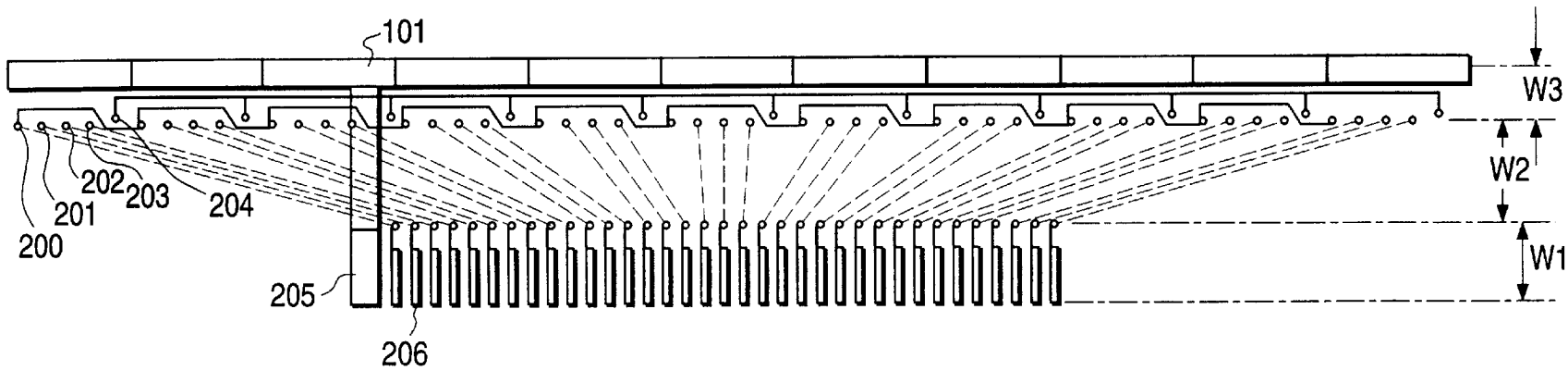
FIG. 12 shows the wiring pattern of the substrate when the connection by wire bonding is effected on the connected side of the flexible cable.

FIG. 12 shows the wiring patterns of the substrate 100 when the connection by wire bonding is done on the connected side of the flexible cables 102. In such a case, as is apparent from FIG. 12, it is necessary that the width W2 of the radial wiring patterns and the width W3 required for wire bonding be secured independently of each other and therefore, the width of the substrate 100 is the total of W1, W2 and W3. Accordingly, in the present embodiment, the substrate 100 and the light emitting element array chips 101 are wire-bonded on the side opposite to the connected side of the flexible cables 102, whereby it is not necessary to newly secure the width required for wire bonding and correspondingly, the width of the substrate 100 can be made small.

By making it unnecessary to increase the width of the flexible cable 102, i.e., widen the wiring patterns to the eleven light emitting element arrays 101, even if the connection by wire bonding is done on the connected side of the flexible cables 102 or on the side opposite thereto, it is possible to make the width of the substrate 100 equal to W1+W3, thus making the width of the substrate 100 even smaller. In this case, however, the cost of the flexible cables becomes high or the width of the heat welded portion becomes great when the substrate and the flexible cables are connected together, whereby a reduction in reliability and a reduction in the yield of mounting are caused and therefore, it is desirable to determine the width of the flexible cable with these factors taken into account.

Also, in the present embodiment, when the flexible cables 102 and the substrate 100 are to be connected together they are connected together on the back of the substrate 100, i.e., the surface opposite to the surface on which the light emitting element array chips 101 are carried and therefore, it does not happen that during soldering heat welding, the solder or a flux used in the soldering heat welding or the like adheres to the light emitting surface of the light emitting element chips 101, and such a situation that will result in the deterioration of the characteristics of the light emitting element array chips can be avoided. Accordingly, without the width of the substrate 100 being made great, the deterioration of the characteristics of the light emitting element array chips due to the scatter of the flux or the like can be prevented. Also, it is not necessary to increase the width of the substrate 100 and therefore, the recording head can be made compact and in an apparatus using it, the use of a photosensitive drum having a smaller diameter becomes possible, and this also contributes to the downsizing of the apparatus.

While in the above-described embodiment, there has been shown an example in which the substrate and the flexible cables are connected together by soldering heat welding, the connection may be done by soldering with a flat cable used on the back of the substrate or may be done by soldering by the use of a connector. Also, the substrate 100 carrying the light emitting element array chips thereon is a two-surface substrate, but alternatively, a multilayer substrate may be used. Further, while light emitting element array chips of the self-scanning type have been shown as the light emitting element array chips, the present invention is not restricted thereto, but can also be applied to a case where use is made of other recording elements such as LEDs having a similar self-scanning circuit and capable of usual time-divisional driving.

As described above, according to the present invention, the substrate on which the light emitting element array chips are carried and the connecting member are connected together on the back of the substrate on which the light emitting element array chips are carried, whereby a flux or the like does not adhere to the surfaces of the light emitting element array chips, and without the width of the substrate being made great, the deterioration of the characteristics of the light emitting element array chips can be prevented. Accordingly, the recording head can be made compact, and in an apparatus using it, the use of a photosensitive drum having a smaller diameter is made possible, and this can also contribute to the downsizing of the apparatus.

Figure 13:
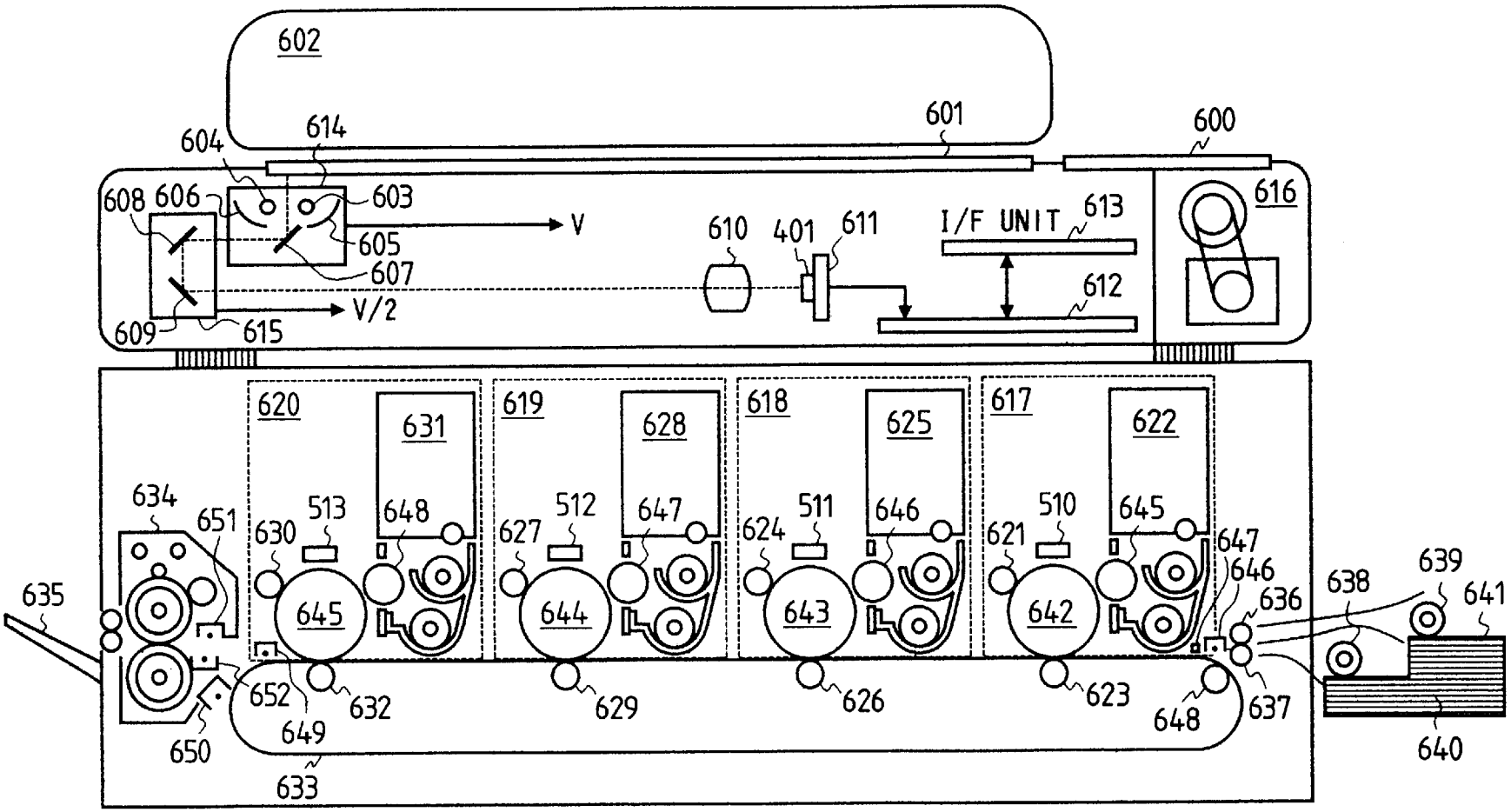
FIG. 13 schematically shows the construction of a color copying apparatus using the recording head of the present invention.

Description will hereinafter be made of a specific embodiment of an image forming apparatus using the recording head according to the above-described embodiment of the present invention. FIG. 13 schematically shows the construction of a color copying apparatus using the recording head of the present invention, FIGS. 14A and 14B are block diagrams showing the construction of a digital image processing section 612, and FIG. 15 is a block diagram showing the construction of an LED image recording section.

The construction of the color copying apparatus of FIG. 13 will hereinafter be described with respect to a color reader section and a printer section, and the recording head of the present invention constitutes a recording head driving section and a recording head section in the printer section which will be described later.

(Color Reader Section)

Figure 14B:
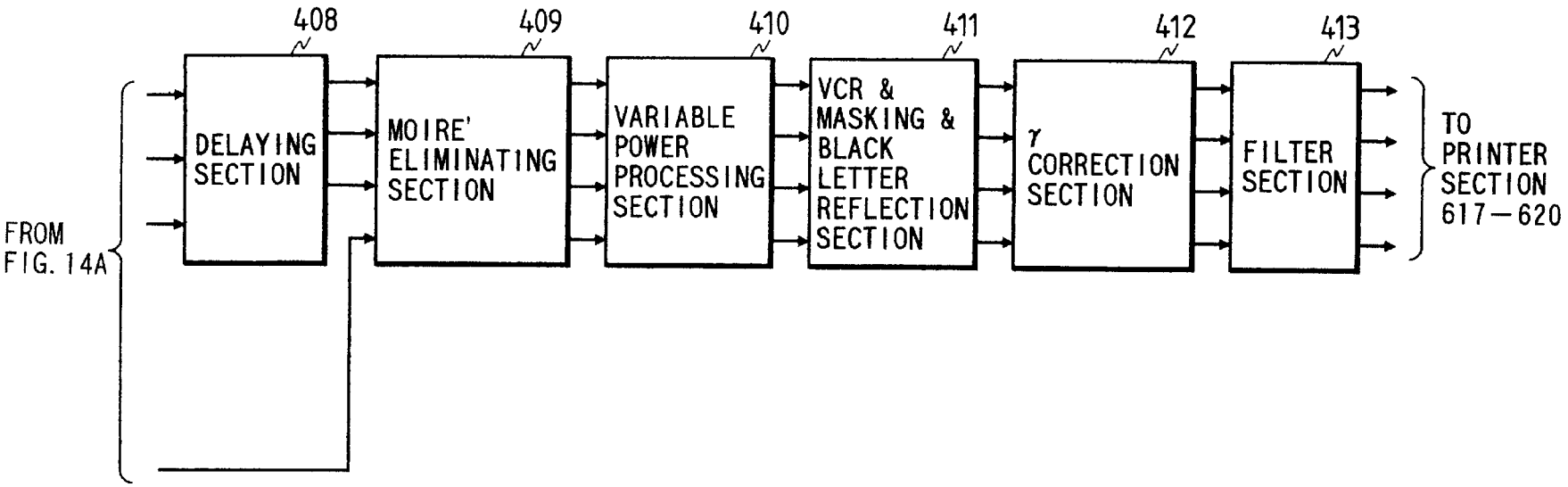
FIG. 14 is comprised of FIGS. 14A and 14B, which are block diagrams showing the detailed construction of a digital image processing portion 612.
Figure 15:
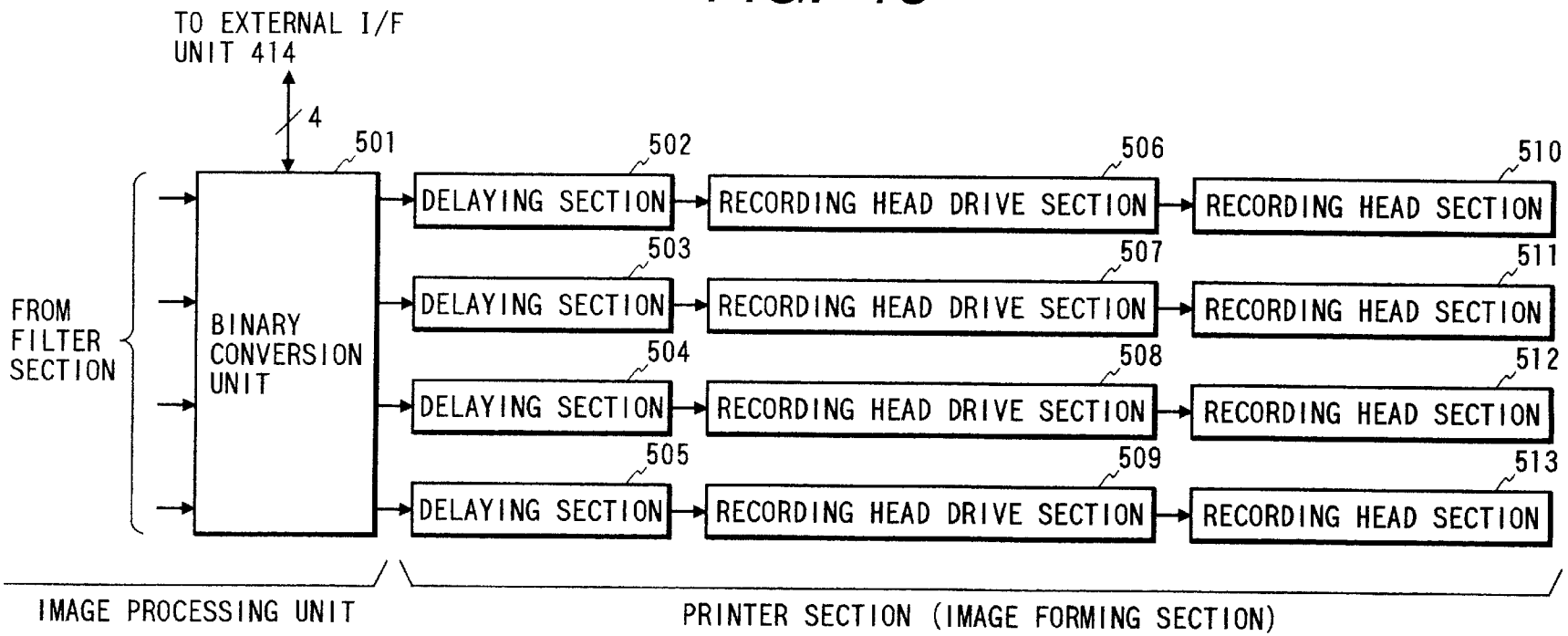
FIG. 15 is a block diagram showing the construction of an image recording portion.

The color reader section is shown in the upper portion of FIG. 13, and in FIG. 13, reference numeral 401 designates a CCD, reference numeral 611 denotes a substrate on which the CCD 401 is actually mounted, reference numeral 612 designates an image processing section excluding the section 401 of the image processing section of FIGS. 14A and 14B and including the sections 501 and 502 to 505 of FIG. 15, reference numeral 601 denotes original supporting table glass (platen), reference numeral 602 designates an original feeding device (DF) (there is also a construction in which a mirror surface pressure plate, not shown, is mounted instead of this original feeding device 602), reference numerals 603 and 604 denote light sources (halogen lamps or fluorescent lamps) for illuminating an original, reference numerals 605 and 606 designate reflectors for condensing the lights of the light sources 603 and 604 onto the original, reference numerals 607 to 609 denote mirrors, reference numeral 610 designates a lens for condensing the reflected light or projected light from the original onto the CCD 401, reference numeral 614 denotes a carriage containing the halogen lamps 603, 604, the reflectors 605, 606 and the mirror 607 therein, reference numeral 615 designates a carriage containing the mirrors 608 and 609 therein, and reference numeral 613 denotes an interface (I/F) unit with other IPU or the like. The carriage 614 and the carriage 615 are mechanically moved at velocity V and velocity V/2, respectively, perpendicularly to the electrical scanning (main scanning) direction of the CCD 401 to thereby scan (sub-scan) the whole surface of the original. Also, reference numeral 600 designates the operating section of a copying apparatus, and reference numeral 616 denotes driving means for the carriages 614 and 615.

FIGS. 14A and 14B are block diagrams showing the detailed construction of a digital image processing section 612. The original on the original supporting table glass reflects the lights from the light sources 603 and 604, and those reflected lights are directed to the CCD 401, by which they are converted into an electrical signal (in the case of a color sensor, the CCD 401 may be one in which color filters R, G and B are side-by-side in line on a one-line CCD in the order of R, G and B, or may be a three-line CCD in which R filter, G filter and B filter are arranged for respective CCDs, or may be one in which filters are made into chips or filters are discrete in construction from CCDs). The electrical signal (analog image signal) is inputted to the image processing section 612, and is sample-held (S/H) by a clamp & amp. & S/H & A/D section 402, and the dark level of the analog image signal is clamped into reference potential, is amplified to a predetermined amount (the above-mentioned order of processing is not always the inscribed order), is A/D-converted, for example, converted into a digital signal of 8 bits for each of R, G and B. The RGB signal is subjected to shading correction and black correction in a shading section 403, whereafter in a concatenation & MTF correction & original detection section 404, when the CCD 401 is a three-line CCD, the concatenation process adjusts the amount of delay for each line in conformity with a reading speed because the reading positions between the lines differ from each other, and corrects the signal timing so that the reading positions for three lines may become the same, and because MTF of reading changes depending on the reading speed and variable power factor, MTF correction corrects that change, and original detection scans the original on the original supporting table glass to thereby recognize the size of the original. The digital signal of which the reading position timing has been corrected corrects the spectral characteristic of the CCD 401 and the spectral characteristics of the light sources 603, 604 and the reflectors 605, 606 by an input masking section 405. The output of the input masking section 405 is inputted to a selector 406 changeable over with the external I/F signal from the external I/F unit 414 of the I/F section 613. The signal outputted from the selector 406 is inputted to a color space compression & grounding elimination & log conversion section 407 and a grounding removing section 415. The signal inputted to the grounding removing section 415 is grounding-removed, whereafter it is inputted to a black letter discriminating section 416 for discriminating whether the signal is a black letter in the original, and produces a black letter signal from the original. Also, in the color space compression & grounding elimination & log conversion section 407 to which another output of the selector 406 has been inputted, the color space compression judges whether the read image signal is within a range which can be reproduced by a printer, and keeps the image signal as it is when the image signal is within the range, and corrects the image signal so as to be within the range which can be reproduced by the printer when the image signal is not within the range. Then, the grounding eliminating process is carried out, and in the log conversion, RGB signal is converted into CMY signal. In order to correct the signal produced in the black letter discriminating section 416 and the timing, the output signal of the color space compression & grounding elimination & log conversion section 407 has its timing adjusted by a delaying section 408. These two kinds of signals have their moiré eliminated by a moiré eliminating section 409, and are variable-power-processed in the main scanning direction by a variable power processing section 410. Reference numeral 411 designates a UCR & masking & black letter reflection section, and as regards the signals processed by the variable power processing section 410, CMYK signal is produced from CMY signal by UCR processing, and is corrected into a signal matching the output of the printer by the masking processing section and the discrimination signal produced by the black letter discriminating section 416 is fed back to the CMYK signal. The signal processed by the UCR & masking and black letter reflection section 411 is density-adjusted by a γ correction section 412, whereafter it is smoothed or edge-processed by a filter section 413. The signal processed as described above is converted from a multivalue signal of 8 bits into a binary signal by a binary conversion unit designated by 501 in FIG. 15. (The converting method may be any of the diza method, an error diffusing method and improved error diffusion.)

(Printer Section)

The printer section is shown in the lower portion of FIG. 13, and reference numeral 617 denotes an M image forming section, reference numeral 618 designates a C image forming section, reference numeral 619 denotes a Y image forming section, and reference numeral 620 designates a K image forming section, and these sections are the same in construction and therefore, herein the M image forming section 617 will be described in detail and the other image forming sections need not be described. The recording head of the present invention constitutes recording head drive sections 506 to 509 and recording head sections 510 to 513, and is shown in FIG. 15.

As shown in FIG. 13, in the M image forming section 617, reference numeral 642 designates a photosensitive drum, on the surface of which a latent image is formed by the light from a recording head section 510. Reference numeral 621 denotes a primary charger which charges the surface of the photosensitive drum 642 to predetermined potential and prepares for latent image formation. Reference numeral 622 designates a developing device which develops the latent image on the photosensitive drum 642 to thereby form a toner image. The developing device 622 includes a sleeve 645 for applying a developing bias to thereby develop the latent image. Reference numeral 623 denotes a transfer charger which effects discharge from the back of a transfer belt 633 and transfers the toner image on the photosensitive drum 642 to a recording sheet or the like on the transfer belt 633. In the present embodiment, transfer efficiency is good and therefore, there is not disposed a cleaner section (of course, there is no problem even if a cleaner section is mounted).

Description will now be made of the procedure of forming an image on the recording sheet or the like. Recording sheets or the like contained in cassettes 640 and 641 are supplied one by one onto the transfer belt 633 by paper supply rollers 636 and 637. The thus supplied recording sheet is charged by a suction charger 646. Reference numeral 648 denotes a transfer belt roller which drives the transfer belt 633 and charges the recording sheet or the like in a pair with the suction charger 646, thereby causing the recording sheet or the like to be attracted to the transfer belt 633. Reference numeral 647 designates a paper end sensor which detects the leading end of the recording sheet or the like on the transfer belt 633. The detection signal of the paper end sensor is sent from the printer section to the color reader section and is used as a sub-scanning synchronous signal when a video signal is sent from the color reader section to the printer section.

Thereafter, the recording sheet or the like is conveyed by the transfer belt 633, and in the image forming sections 617 to 620, toner images are formed on the surface thereof in the order of M, C, Y and K. The recording sheet or the like passed through the K image forming section 620 has its charges removed by a charge removing charger 649 to facilitate the separation thereof from the transfer belt 633, whereafter the recording sheet or the like is separated from the transfer belt 633. Reference numeral 650 denotes a peeling charger which prevents the disturbance of the image due to peeling discharge when the recording sheet or the like is separated from the transfer belt 633. The separated recording sheet or the like is charged by before-fixation chargers 651 and 652 to supplement the attracting force of the toner and prevent the disturbance of the image, whereafter the toner image is heat-fixated by a fixating device 634, whereafter the recording sheet or the like is discharged onto a paper discharge tray 635.

The image recording by the recording head will now be described. As shown in FIG. 15, the binary CMYK image signals produced by the image processing unit of FIGS. 14A and 14B and the signal produced by the binary conversion unit 501 on the basis of the paper end signal from the paper end sensor 647 adjust the differences between the distances between the paper end sensor and the image forming sections 617 to 620 by delaying sections 502 to 505 to thereby become capable of printing four colors at a predetermined position. The recording head drive sections 506 to 509 produce signals for driving the recording head sections 510 to 513. The light emitting elements (recording head sections) arranged in a row are turned on or turned off in conformity with a recording signal (image signal) and effect recording on the photosensitive drum.

As described above, the recording head of the present invention is compact and therefore, in an image forming apparatus using it, the use of a photosensitive drum having a smaller diameter becomes possible and thus, the downsizing of the image forming apparatus itself also becomes possible.

What is claimed is:

1. A recording head comprising:

a light emitting element array having a plurality of light emitting elements;

a first substrate having a surface on which said light emitting element array is carried;

a drive element for driving said light emitting element array;

a second substrate on which said drive element is carried; and a connecting member for connecting said first substrate and said second substrate together;

said first substrate being connected to said connecting member by heat welding on a surface of said first substrate opposite and parallel to the substrate surface on which said light emitting element array is carried.

2. A recording head according to claim 1, wherein said light emitting element array contains a self-scanning circuit therein.

3. A recording head according to claim 1, wherein said connecting member is a flexible cable.

4. A recording head according to claim 1, further comprising a base member on which said first and second substrates are installed so as to define an angle of 90 degrees.

5. A recording head according to claim 1, further comprising a wiring pattern formed on said first substrate and an electrically conductive pattern formed on said connecting member, and said light emitting element array further comprising at least one electrode, wherein said wiring pattern and said electrode are connected together by wire forming wire bonding, and said wiring pattern and said electrically conductive pattern are connected together by additional wire forming wire bonding.

6. An image forming apparatus comprising:

a light emitting element array having a plurality of light emitting elements;

a first substrate having a surface on which said light emitting element array is carried;

a drive element for driving said light emitting element array;

a second substrate on which said drive element is carried;

a connecting member for connecting said first substrate and said second substrate together; and a photosensitive medium on which recording is effected by said light emitting element array;

said first substrate being connected to said connecting member by heat welding on a surface of said first substrate opposite and parallel to the substrate surface on which said light emitting element array is carried.

7. An image forming apparatus according to claim 6, wherein said light emitting element array contains a self-scanning circuit therein.

8. An image forming apparatus according to claim 6, wherein said connecting member is a flexible cable.

9. An image forming apparatus according to claim 6, further comprising a base member on which said first and second substrates are installed so as to define an angle of 90 degrees.

10. An image forming apparatus according to claim 6, further comprising a wiring pattern formed on said first substrate and an electrically conductive pattern formed on said connecting member, and said light emitting element array further comprising at least one electrode, wherein said wiring pattern and said electrode are connected together by wire forming wire bonding, and said wiring pattern and said electrically conductive pattern are connected together by additional wire forming wire bonding.

11. A recording head comprising:

a light emitting element array having a plurality of light emitting elements;

a first substrate having a surface on which said light emitting element array is carried;

a drive element for driving said light emitting element array;

a second substrate having a surface on which said drive element is carried; and a connecting member for connecting said first substrate and said second substrate together;

said second substrate being connected to said connecting member by heat welding on a surface of said second substrate opposite and parallel to the substrate surface on which said drive element is carried.

12. A recording head according to claim 11, wherein said light emitting element array contains a self-scanning circuit therein.

13. A recording head according to claim 11, wherein said connecting member is a flexible cable.

14. A recording head according to claim 11, further comprising a base member on which said first and second substrate are installed so as to define an angle of 90 degrees.

15. A recording head according to claim 11, further comprising a wiring pattern formed on said first substrate and an electrically conductive pattern formed on said connecting member, and said light emitting element array further comprising at least one electrode, wherein said wiring pattern and said electrode are connected together by wire forming wire bonding, and said wiring pattern and said electrically conductive pattern are connected together by additional wire forming wire bonding.

16. An image forming apparatus comprising:

a light emitting element array having a plurality of light emitting elements;

a first substrate on which said light emitting element array is carried;

a drive element for driving said light emitting element array;

a second substrate having a surface on which said drive element is carried;

a connecting member for connecting said first substrate and said second substrate together; and a photosensitive medium on which recording is effected by said light emitting element array;

said second substrate being connected to said connecting member by heat welding on a surface of said second substrate opposite and parallel to the substrate surface on which said drive element is carried.

17. An image forming apparatus according to claim 16, wherein said light emitting element array contains a self-scanning circuit therein.

18. An image forming apparatus according to claim 16, wherein said connecting member is a flexible cable.

19. An image forming apparatus according to claim 16, further comprising a base member on which said first and second substrates are installed so as to define an angle of 90 degrees.

20. An image forming apparatus according to claim 16, further comprising a wiring pattern formed on said first substrate and an electrically conductive pattern formed on said connecting member, and said light emitting element array further comprising at least one electrode, wherein said wiring pattern and said electrode are connected together by wire forming wire bonding, and said wiring pattern and said electrically conductive pattern are connected together by additional wire forming wire bonding.

* * * * *

UNITED STATES PATENT AND TRADEMARK OFFICE

CERTIFICATE OF CORRECTION

PATENT NO. : 6,069,644
DATED : May 30, 2000
INVENTOR(S) : Hiroshi Tanioka et al.

It is certified that error appears in the above-identified patent and that said Letters Patent is hereby corrected as shown below:

Title page,
Item [56], References Cited, U.S. PATENT DOCUMENTS,
Before "4,640,601 2/1987 Deguchi et al. ..... 355/1 X" insert
-- 4,506,272 3/1985 Arai .....347/210 --.

After "4,640,601 2/1987 Deguchi et al. ..... 355/1 X" insert
-- 4,899,174 2/1990 Newman et al. .....347/238 X --.

Column 1,
Line 7, "a as" should read -- as --.
Line 59, "a head" should read -- head --.

Column 10,
Line 15, "According," should read -- Accordingly, --.

Column 17,
Line 33, "substrate" should read -- substrates --.

Signed and Sealed this

Twenty-fifth Day of December, 2001

*Attest:*

*Attesting Officer*

JAMES E. ROGAN
*Director of the United States Patent and Trademark Office*